United States Patent [19]

Siahou

[11] Patent Number: 4,502,497

[45] Date of Patent: Mar. 5, 1985

[54] TOOTHBRUSH FOR POLARIZING THE ACTIVE INGREDIENTS OF TOOTHPASTE

[76] Inventor: Joseph Siahou, 13 rue Pascal, 13007 Marseille, France

[21] Appl. No.: 462,051

[22] Filed: Jan. 28, 1983

[51] Int. Cl.[3] ..... A45D 44/18

[52] U.S. Cl. ..... 132/84 R; 604/20

[58] Field of Search ..... 132/84 R; 604/20, 787; 128/172.1

[56] References Cited

U.S. PATENT DOCUMENTS

| | | | |
|---|---|---|---|
| 2,798,241 | 7/1957 | Cohen | 132/84 R |
| 3,412,731 | 11/1968 | Reynolds | 604/20 |
| 3,520,297 | 7/1970 | Bechtold | 604/20 |

FOREIGN PATENT DOCUMENTS

| | | | |
|---|---|---|---|
| 2217689 | 10/1972 | Fed. Rep. of Germany | 604/20 |
| 2646265 | 4/1978 | Fed. Rep. of Germany | 132/84 D |

*Primary Examiner*—Gregory E. McNeill

*Attorney, Agent, or Firm*—Sandler & Greenblum

[57] ABSTRACT

A toothbrush for increasing the concentration of fluoride ions in micro-porous openings in the teeth when fluoride toothpaste is brushed onto the teeth in the mouth. The toothbrush includes at least one magnet in contact with dialectric material, a conductor in contact with the magnet, and conductive bristles in contact with the conductor. The dialectric material, the conductor and the conductive bristles together comprise means for rapidly diffusing fluoride ions in the mouth when fluoride toothpaste is brushed on the teeth by the bristles.

11 Claims, 4 Drawing Figures

TOOTHBRUSH FOR POLARIZING THE ACTIVE INGREDIENTS OF TOOTHPASTE

BACKGROUND OF THE INVENTION

1. Field of the Invention

The invention relates to a toothbrush device designed to polarize the active ingredients of toothpaste.

More specifically, it has as its goal to increase the concentration of active F ions or fluorine ions in barely accessible points in the mouth during brushing of the teeth with a fluoride toothpaste.

2. Description of the Prior Art

It is known to use electrodes or batteries so that the active ingredient in fluoride toothpaste that is mechanically spread on the teeth and the gums by means of brushing can penetrate places difficult to access, such as the spaces between the teeth and micro-porous openings in the teeth. However, in these known devices, the cumbersomeness of the diverse elements do not allow their incorporation, in a normal fashion, in the head of the brush. Furthermore, the difficulties involved in their manufacture considerably increase the price of such a toothbrush. Moreover, it has been ascertained that the F ions in the toothpaste placed on such a prior art brush and which partially dissolve in the saliva and water which are eventually introduced, are not spread rapidly enough to all parts of the liquid in the mouth. As a result, these prior art brushes pose a hydrodynamic problem for the diffusion coefficient of the F ions in the mouth.

SUMMARY OF THE INVENTION

The device according to the invention, improves the diffusion of F ions and their penetration into inaccessible spaces by brushing and accelerates their action in the microporous openings of the teeth. In addition, the toothbrush of the present invention is designed to polarize the active ingredients of the fluoride toothpaste by the ionization and polarization of emitting surfaces on the toothbrush which emit magnetic and static electric fields, and by ionizing and polarizing the receiving surfaces of the teeth and the active ingredients and the agents used for cleaning the teeth in the toothpaste. This is achieved by improved hydrodynamic action inside the mouth, combined with the action of a magnetic field produced by permanent magnets and with the action of a static electric field and the electrothermal effects of human heat.

In one embodiment this effect is achieved by combining the magnetic effects of a powerful, permanent magnet or magnetic suction cup with currents of static electricity emitted by the human body and activated by the energy from body heat transmitted by the hand.

BRIEF DESCRIPTION OF THE DRAWINGS

In the attached drawings, given as non-limiting examples, an embodiment of the invention is shown, wherein.

DETAILED DESCRIPTION OF THE PREFERRED EMBODIMENTS

The present invention has as its goal to activate fluoride or F ions and to polarize the active ingredients which comprise fluoride toothpaste with respect to the polarization of a receiving surface, such as the tooth. This goal is accomplished by using magnetic fields which are applied to the toothpaste, as well as channeled static electricity.

When the present invention is used, the resulting variations in the surface tension of the micro-polarized active ingredients accelerates the effects of the ascending and descending capillary action of the toothpaste in order to allow the active ingredients to penetrate the spaces between the teeth and into the micro-cavities never reached with ordinary brushing.

Figure 1:
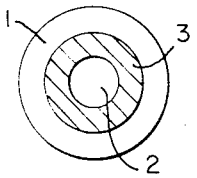
FIGS. 1 and 2 illustrate top views of powerful, permanent magnets or magnetic suction cups of a reduced volume of the present invention.
Figure 2:
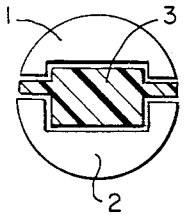
Figure 3:
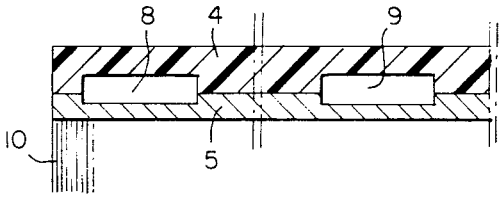
FIG. 3 illustrates a cross-sectional view of an assembly combining an emitter, conductor and insulator elements of the toothbrush.

The use of magnetic field produces a variation in the fractioning of the molecules of the toothpaste by the addition of electrons to molecule atoms or groups of the latter. The magnetic field is produced, as seen in FIGS. 1 and 2, by a magnet which comprises magnetic surfaces 1,2 with a neutral zone 3 positioned between and separating magnetic surfaces 1 and 2.

These powerful, permanent magnets are insulated in a dielectric support 4 and are surrounded by a static electricity conducting mass 5 which extends along the underside 6 of the brush 7 from the handle 12 and covers a head 11 of brush 7.

Conductor 5 guarantees the thermal and electric conductivity of the toothbrush; it is within the scope of the invention for conductor 5 to be either magnetic or non-magnetic. Furthermore, it is within the scope of the invention for conductor 5 to cover the magnets or surround the magnets.

The head 11 of the brush may contain either a magnet 8 and/or a second magnet 9.

Figure 4:
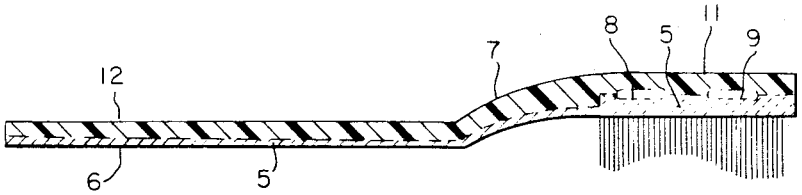
FIG. 4 illustrates a side view of the combination of elements comprising the toothbrush of the present invention.

Bristles of magnetic synthetic resin 10 are implanted in the conductive surface 5 at head 11. Conductive surface 5 is preferably thicker at the emission point located along the entire length of the head of the brush 11, as seen in FIG. 4.

This conductive surface or sector 5 which preferably covers the length of handle 12 experiences thermal effects from the hand of the user who squeezes it with pressure.

As a result of this structure, when the toothbrush of the present invention is used to brush the teeth a type of condenser is formed which is traversed by the magnetic field of the magnets and is grounded by the brush and toothpaste moistened by the mouth of the user.

This combination of a magnetic field and of polarized static electricity modifies the hydrodynamic operation of the brushing of the teeth. Furthermore, neutral zone 3 influences the magnetic effects of powerful magnet 8 and/or 9 and influences the static electric currents. As a result of these magnetic and static electric fields the F ions are activated. These F ions themselves are electrically charged particles formed from an atom or a group of atoms which have lost or gained several electrons.

Because of the effects of the attraction of molecules of the toothpaste and teeth surfaces that have different polarities and the repulsion of molecules of the toothpaste and teeth surfaces having identical polarization, the F ions are recharged. As a result, the F ions become electrolytic ions which penetrate the micro-porous opening in the teeth, thereby grounding the F ions. The micro-porous openings have an opposite polarization from the F ions, thereby attracting the F ions.

The hydrodynamic action resulting from the use of the toothbrush of the present invention influences the movement of the positive and negative ions as well as their progress across the liquid in the mouth, which thereby coats and penetrates the micro-porous openings of the teeth.

It is within the scope of the invention to vary the materials of which the magnets, the neutral materials, the conductors of static electricity and the di-electric materials are comprised. Furthermore, the positions of the magnets, the neutral materials, the conductors of static electricity and the dielectric materials can vary within the limits of equivalency, without changing the general concept of the invention which has been described here.

I claim:

1. A toothbrush for increasing the concentration of fluoride ions in predetermined portions of the teeth when fluoride toothpaste is brushed onto the teeth in the mouth, wherein said toothbrush comprises:

(a) a dielectric material;

(b) at least one magnet in contact with said dielectric material;

(c) a conductor in contact with said at least one magnet; and (d) conductive bristles in contact with said conductor, wherein said dielectric material, said magnet, said conductor and said conductive bristles together comprise a means for rapidly diffusing said fluoride ions in the mouth when fluoride toothpaste is brushed on said teeth by said bristles.

2. The toothbrush defined by claim 1 wherein said conductive brush is composed of magnetic synthetic resin.

3. The toothbrush defined by claim 1 wherein said toothbrush further comprises:

(e) a head; and (f) a handle, wherein said at least one magnet is positioned in said head and wherein said handle and head each have a bottom portion and wherein said conductor is located on said bottom portion of said handle and head, and wherein said conductor is a thermal conductor and conducts static electricity.

4. The toothbrush defined by claim 3 wherein said handle and head each have a top portion and wherein said dielectric material is located on said top portion of said handle and head, and wherein said at least one magnet is disposed between said top portion and said bottom portion of said head.

5. The toothbrush defined by claim 4 wherein said at least one magnet comprises two magnetic surfaces separated by a magnetically neutral zone therebetween.

6. The toothbrush defined by claim 1 wherein said toothbrush comprises two magnets.

7. The toothbrush defined by claim 1 wherein said conductor is magnetic.

8. The toothbrush defined by claim 7 wherein said at least one magnet has surfaces which comprise means for emitting a magnetic field, wherein said emitting surfaces are covered by said conductor.

9. The toothbrush defined by claim 1 wherein said toothbrush is adapted to brush teeth with a fluoride toothpaste having active ingredients and wherein said diffusing means comprises a polarizing means for polarizing said active ingredients of said toothpaste.

10. The toothbrush defined by claim 9 wherein said toothbrush has an emitting surface for emitting a magnetic field and wherein each tooth has a receiving surface, and wherein said polarizing means comprises means for ionizing and polarizing said emitting and receiving surfaces and for ionizing and polarizing said active ingredients of said toothpaste used for cleaning said teeth.

11. The toothbrush defined by claim 10 wherein said ionizing and polarizing means comprises a means for subjecting said teeth, said fluoride toothpaste and said toothbrush to the combination of hydrodynamic action, a magnetic field, a static electric field, and the electrothermal effects of human heat.

* * * * *